United States Patent [19]

Hickin

[11] 4,366,476

[45] Dec. 28, 1982

[54] RASTER DISPLAY GENERATING SYSTEM

[75] Inventor: Charles W. R. Hickin, Binghamton, N.Y.

[73] Assignee: General Electric Company, Binghamton, N.Y.

[21] Appl. No.: 165,804

[22] Filed: Jul. 3, 1980

[51] Int. Cl.[3] ..... G09G 1/16

[52] U.S. Cl. ..... 340/747; 340/701; 340/721

[58] Field of Search ..... 340/744, 747, 749, 751, 340/701, 793, 727

[56] References Cited

U.S. PATENT DOCUMENTS

| | | | |
|---|---|---|---|
| 3,675,232 | 7/1972 | Strout | 340/744 X |
| 3,792,464 | 2/1974 | Hamada et al. | 340/747 |
| 3,996,585 | 12/1976 | Hogan et al. | 340/747 |
| 4,070,662 | 1/1978 | Narveson . | |
| 4,149,164 | 4/1979 | Reins et al. | 340/701 |
| 4,241,341 | 12/1980 | Thorson | 340/747 X |

OTHER PUBLICATIONS

Bantz and Kreitzer, "Intermixed Update of Memory-Refreshed Raster Displays", IBM Tech. Discl. Bul., vol. 18, No. 8, Jan. 1976, pp. 2705, 2706.

*Primary Examiner*—David L. Trafton
*Attorney, Agent, or Firm*—Arthur E. Bahr; I. David Blumenfeld; Stephen A. Young

[57] ABSTRACT

A visual display system and method for use in converting calligraphic symbology information into raster scanned symbology. The system simultaneously generates and displays calligraphic and raster matrix imagery utilizing the same set of software instructions. The imagery is displayed upon a single, hybrid calligraphic/-raster matrix display or separate raster matrix and calligraphic displays. A programmable calligraphic symbology generator utilizes digital stroking techniques that successively generates addressing for a matrix arrayed memory and determines the attributes of both the raster matrix generated and calligraphic generated symbology. The information is stored in a single or a plurality of matrix arrayed memories according to desired symbol attributes and system performance.

43 Claims, 12 Drawing Figures

| NM | CODE | PROGRAMMERS INPUT | OPERATION |
|---|---|---|---|
| POSX | ASSIGNED | X POSITION VALUE | THE SPECIFIED X POSITION VALUE IS LOADED INTO THE X DIGITAL INTEGRATOR 242. |
| POSY | | Y POSITION VALUE | THE SPECIFIED Y POSITION VALUE IS LOADED INTO THE Y DIGITAL INTEGRATOR 252. |
| STRX | | SEGMENT'S X COMPONENT | THE SPECIFIED X SLOPE IS LOADED INTO THE X STROKER REGISTER 241. |
| STRY | | SEGMENT'S Y VALUE | THE SPECIFIED Y SLOP IS LOADED INTO THE Y STROKER REGISTER 251. |
| SEGL | | SEGMENT | THE SPECIFIED SEGMENT LENGTH WILL BE ENTERED AND STORED FOR RE-USE IN THE SEGMENT LENGTH CIRCUIT. |
| DISC | | ATTRIBUTE SELECTION | THE ADDRESSED ATTRIBUTES WILL BE STORED IN REGISTER, 28. THEY MAY ALSO AFFECT THE CONTROLLER 27. |
| JMP | | ADDRESS OF NEXT INSRUCTION TO BE READ | WILL CAUSE A PROGRAM JUMP TO THE SPECIFIED ADDRESS IN MEMORY, 22. NO RETURN ADDRESS IS STORED. |
| JMS | | BEGINNING ADDRESS OF SUBROUTINE | SAME AS JMP INSTRUCTION EXCEPT A RETURN ADDRESS IS STORED FOR RETURN. |
| RTN | | | RETURNS TO LAST STORED RETURN ADDRESS AND PAGE. |
| NOP | | | NO OPERATION. |

*FIG. 3*

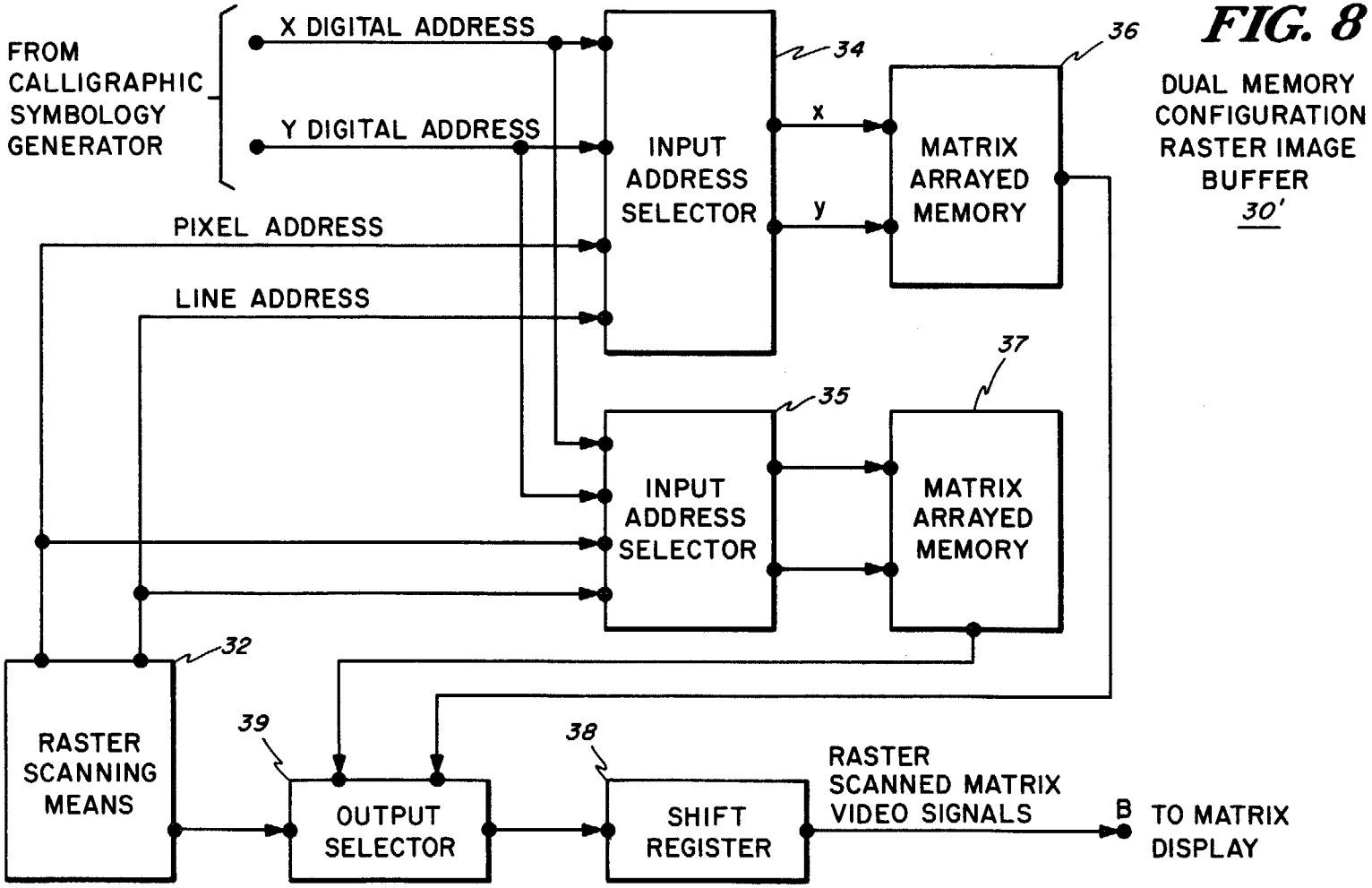
FIG. 8
DUAL MEMORY CONFIGURATION RASTER IMAGE BUFFER 30'
36
MATRIX ARRAYED MEMORY
37
MATRIX ARRAYED MEMORY
34
35
x
y
INPUT ADDRESS SELECTOR
INPUT ADDRESS SELECTOR
X DIGITAL ADDRESS
Y DIGITAL ADDRESS
FROM CALLIGRAPHIC SYMBOLOGY GENERATOR
PIXEL ADDRESS
LINE ADDRESS
32
RASTER SCANNING MEANS
39
OUTPUT SELECTOR
38
SHIFT REGISTER
RASTER SCANNED MATRIX VIDEO SIGNALS
B
TO MATRIX DISPLAY

RASTER DISPLAY GENERATING SYSTEM

BACKGROUND OF THE INVENTION

1. Field of the Invention:

The invention disclosed herein relates to a raster display generating system having means for converting calligraphic symbology information into raster scanned symbology, and more particularly, to such a system wherein symbols are stroked into a raster image buffer for later display on a raster scanned matrix display in raster scanned format.

2. Prior Art:

There are two well-known methods whereby images are formulated on a display device such as a cathode ray tube (CRT). They are calligraphic or stroke image generation and raster scanned image generation. Calligraphic image generation is analogous to writing with a pen. The pen is first positioned at the point where the symbol is to be drawn and then the symbol is stroked out. The pen is positioned for the next symbol and then that symbol is stroked out and so on. Raster scanned image generation is somewhat more complex. The CRT electron beam continuously scans the face of the CRT from left to right, top to bottom (or in some other predefined directions). The beam starts at the upper left hand corner of the display and sweeps to the right; when it gets to the extreme right edge of the display, the beam snaps back to the left side and begins sweeping the next raster display line just below the previous line. It continues to do this until it has swept the entire face of the display device, ending at the bottom right hand corner of the display. At this point the beam snaps back to the top left of the display and begins the process over again. In order for the electron beam to display a symbol on the display, the beam must be turned on and off, that is, blanked and unblanked, in a programmed manner such that a symbol image is formed at the desired point on the display. Since the electron beam does not stop, but instead continues to sweep repetitively across the CRT's face, the symbol generator must know, or predict, where the beam is in order to formulate the image. At a given point on a selected raster line, the beam must be unblanked and then blanked according to a program to generate the top of the symbol. Again on the next succeeding raster line, the beam must be unblanked and blanked to generate the next portion of the symbol. This process continues on to the bottom of the symbol; i.e. the last raster line that the symbol appears. Complications set in when there are a multiplicity of symbols of various shapes and which move about the display according to the functions they represent. Hence, it is more difficult to generate a raster image than to generate a calligraphic image. Nevertheless, a raster display device dissipates less power and is smaller and cheaper than a comparable calligraphic display device. This is important in an aircraft cockpit environment where instrument panel space is at a premium and where the cockpit environment must be cooled. Furthermore, most image sensors for aircraft cockpit applications are presented in a raster format because of cost, size, and complexity. The use of a raster display system improves compatibility and removes the complexity from the display unit in the cockpit to the display generator unit in the equipment bay of the aircraft. Nevertheless calligraphic displays have predominated in aircraft systems until recently because of the display brightness and the overwhelming display generator complexity of raster systems. Improvements, however, have occurred in both of these areas to the point where raster imagery is now becoming the major type of aircraft display system.

There are two methods for generating raster imagery: (1) real time, hardware generation and (2) computed imagery that is stored in a refresh memory. The display generator complexity of the first depends upon the type of imagery displayed. If there are many symbols of various shapes and sizes which must translate over the display face, and if symbols are required to rotate and roll about the display face, the display generator will contain a large amount of hardware. If the display is a text format, then the display generator will be rather simple. The display generator of the second method is much more versatile and in the past included a computer that computed the symbol's shape, size and position, storing them in a refresh memory. The refresh memory would then be scanned in synchronism with the sweep of the electron beam across the CRT face, and according to the data within the refresh memory, the beam would be modulated thereby generating the images. For a complex display, this involved a very large computer, but any symbol could be generated and displayed. Until the advent of integrated circuit random-access-memory (RAM) devices, the physical size of the memory was quite large. This type of system, therefore, was not compatible for aircraft cockpit displays.

It is desirable, therefore, to provide a system and a method for generating a complex raster display including means for stroking symbology into a refresh memory using calligraphic symbol generation techniques and ultimately to provide such symbology in raster scanned format to a raster scanned matrix display for presentation.

OBJECTS AND SUMMARY OF THE INVENTION

It is accordingly an object of the present invention to provide an improved raster display generating system and method for converting calligraphic symbology information into raster scanned symbology for presentation on a raster scanned matrix display.

A further object is to provide an improved raster display generating system whereby both calligraphic and raster scanned symbology are generated for display, utilizing only a single set of software instructions.

Additional objects and advantages of the invention will be set forth in part in a description which follows, and part will be apparent from the description or may be learned by practice of the invention. The objects and advantages of the invention may be realized and obtained by means of the instrumentalities and combinations particularly pointed out in the appended claims.

To achieve the foregoing objects in accordance with a first aspect of the invention, as embodied and broadly described herein, the raster display generating system of the present invention comprises a raster scanned matrix display for displaying information to an observer, the matrix display having an input for receiving video signals, a calligraphic symbology generator for converting information to be displayed on the matrix display into calligraphic symbology by stroking complete symbols, at least one symbol making up a complete display image, the generator having an output, and a raster image buffer having an input for receiving from the generator output calligraphic symbology and for converting this symbology into raster scanned format and for storing for later display on the matrix display, the buffer having an output providing video signals to the input of the matrix display.

In accordance with a further aspect of the invention, as embodied and broadly described herein, the system of the present invention for converting calligraphic symbology into raster scanned symbology for feeding into a raster scanned matrix display comprises a calligraphic symbology generator for converting information to be displayed on the matrix display into calligraphic symbology by stroking complete symbols, at lease one symbol making up a complete display image, the generator having an output, and a raster image buffer having an input for receiving from the generator output calligraphic symbology and for converting the symbology into raster scanned format and for storing for later display on the matrix display, the buffer having an output providing video signals adapted for feeding to the matrix display.

In accordance with a still further aspect of the invention, as embodied and broadly described herein, the raster display system of the present invention comprises a raster scanned matrix display for displaying information to an observer, the matrix display having an input for receiving raster scanned video signals, a calligraphic symbology generator for converting information to be displayed on the matrix display into calligraphic symbology by stroking complete symbols, at lease one symbol making up a complete display image, the generator having an output, a raster image buffer having an input for receiving from the generator output calligraphic symbology and for converting the symbology into raster scanned format and for storing for later display on the matrix display, the buffer having an output providing raster scanned video signals to the input of the matrix display, and means for inputting into the system externally generated signals representing real time and reconstituted imagery.

In accordance with yet another aspect of the invention, as embodied and broadly described herein, a method is provided for converting calligraphic symbology information into raster scanned symbology for display on a raster scanned matrix display comprising the steps of generating a consecutive series of X and Y addresses corresponding to the line segments of the symbol being stroked, and converting this consecutive series of addresses into corresponding pixel locations and storing the pixel locations for refreshing the display image at a later time.

The accompanying drawings, which are incorporated in and constitute a part of this specification, illustrate one embodiment of the invention and, together with the description, serve to explain the principles of the invention.

BRIEF DESCRIPTION OF THE DRAWING

FIG. 3 is a chart showing the basic instruction repertoire of the calligraphic symbology generator of FIG. 2.

FIG. 8 shows in block form an alternate arrangement of FIG. 6 wherein a second matrix arrayed memory is incorporated in the raster image buffer.

DESCRIPTION OF THE PREFERRED EMBODIMENT

Figure 1:
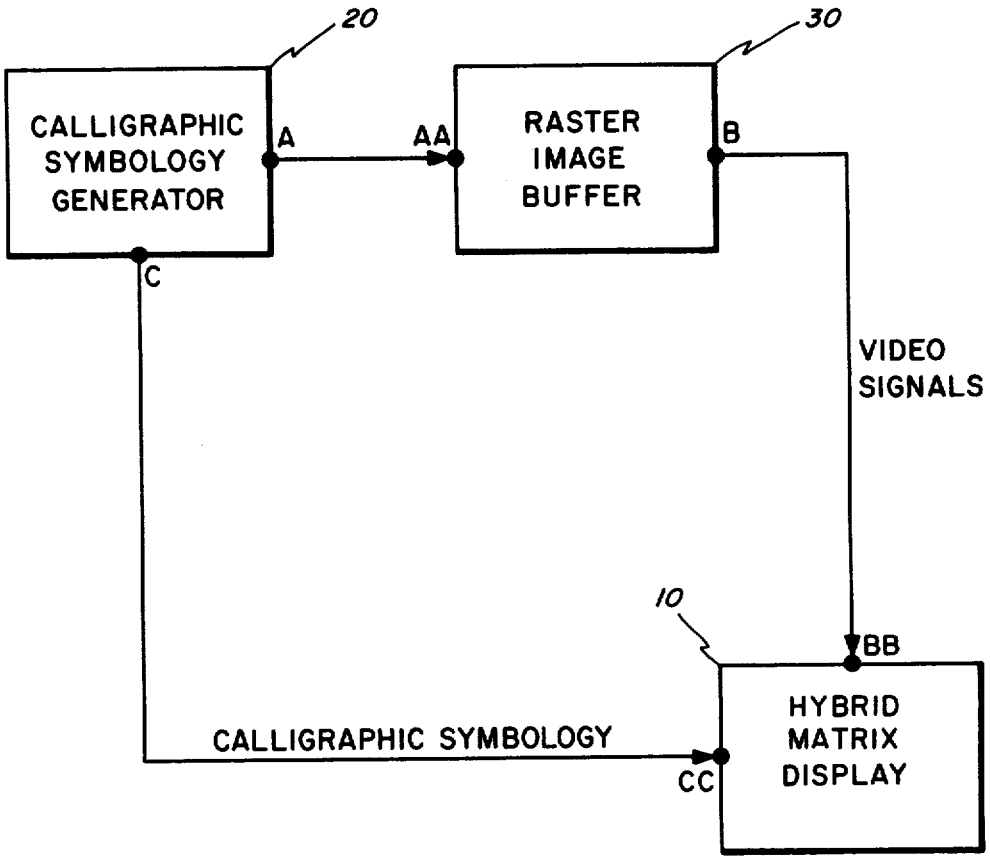
FIG. 1 is a block diagram illustrating the preferred embodiment of a raster display generating system having means for converting calligraphic symbology information into raster scanned symbology.

FIG. 1 shows, in block form, the raster display generating system in accordance with a preferred embodiment of the invention. In one aspect of the invention, there is provided a system for converting calligraphic symbology information into raster scanned symbology for feeding into a raster scanned matrix display 10 for displaying information to an observer. A calligraphic symbology generator 20 is provided for converting information to be displayed into calligraphic symbology. A raster image buffer 30 includes an input AA for receiving from the output A of symbology generator 20 and for storing calligraphic symbology and for converting the symbology into raster scanned format for display on the matrix display 10. The raster image buffer 30 (RIB) includes an output B providing video signals to the input BB of the matrix display 10.

In another aspect of the invention, there is provided a raster display generating system which further includes a raster scanned matrix display 10, which in the preferred embodiment is a hybrid matrix display such as a cathode ray tube (CRT), but it will be appreciated that the invention is applicable to other types of displays as well; such as: gas plasma displays, electro-luminescent displays, and the like.

Figure 2:
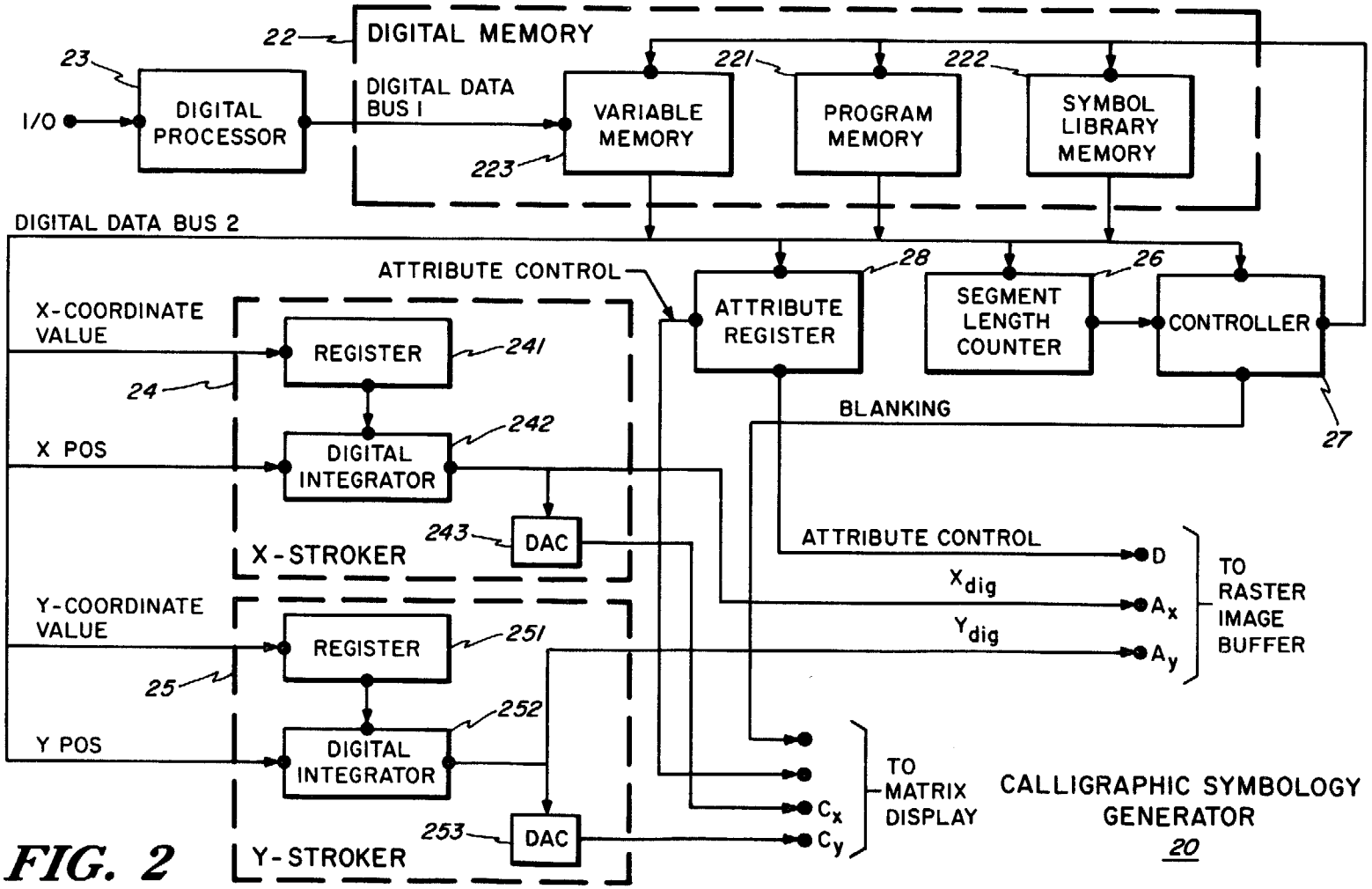
FIG. 2 shows in more detail a block diagram representation of the calligraphic symbology generator of FIG. 1.

Referring now to FIG. 2, there is shown in more detail in block diagram form the circuit of calligraphic symbology generator 20. Included is a digital memory 22 provided with a program memory 221, a symbol library memory 222 and a variable memory 223. Program memory 221 serves to call out a sequence of symbols to be generated, symbol library memory 222 serves to provide for orderly calling out of a sequence of line segments defining the symbol being generated, and variable memory 223 serves to effect orientation and movement on the display 10 of each generated symbol. A digital processor 23 is provided for feeding digital data information to variable memory 223 for effecting movement and change of orientation of the generated symbols.

Calligraphic symbology generator 20 further includes a first digital stroker, X-stroker 24, for receiving the X-coordinate value of the line segment of a symbol being generated and for providing an X-address in digital form for addressing the raster image buffer 30, and a second digital stroker, Y-stroker 25, for receiving the Y-coordinate value of the line segments of a symbol being generated and for providing a Y-address in digital form for addressing RIB 30. Each of X-stroker 24 and Y-stroker 25 is provided with a register for storing the respective coordinate values and a digital integrator for integrating the values, the output of which for each value is the displayed symbol segment.

Calligraphic symbology generator 20 further includes a segment length counter 26 and a controller 27. Counter 26 receives an input from digital memory 22 for defining the length of the current symbol segment and is provided with an output to controller 27. Controller 27 receives the output from counter 26 for effecting addressing the program memory 221 for the next instruction.

Figure 6:
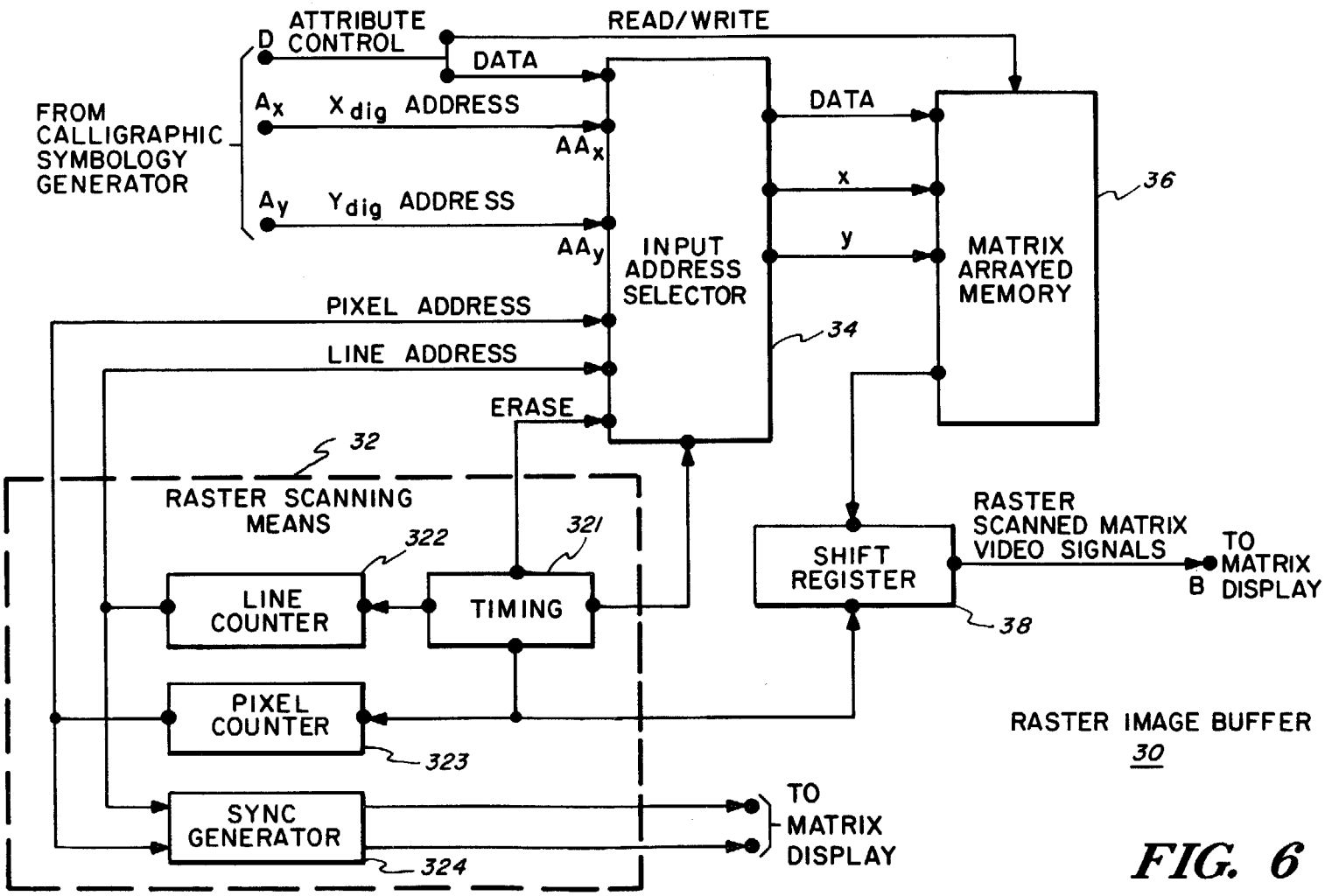
FIG. 6 shows the preferred embodiment, in block diagram form, of the raster image buffer of FIG. 1.

Referring now to FIG. 6, there is shown in more detail, in block diagram form, the preferred embodiment of the circuit of raster image buffer 30. Included is a raster scanning subcircuit 32 having means for providing timing information and pixel and line addressing information. Such would include timing means 321, line counter 322 and pixel counter 323.

RIB 30 also includes an input address selector 34 for receiving the output from calligraphic symbology generator 20 and for receiving timing and addressing information from the raster scanning subcircuit 32 so as to provide output addresses. Also included is a matrix arrayed memory 36 receiving the output addresses from the input address selector 34 for effecting addressing of individual memory elements within the matrix arrayed memory and for providing an output which is a line by line composite of the raster image. A shift register 38 is included for receiving the output from matrix arrayed memory 36 and for orderly presenting each pixel of an image on each raster line to the matrix display 10 in the form of a raster scanned matrix video signal.

Figure 9:
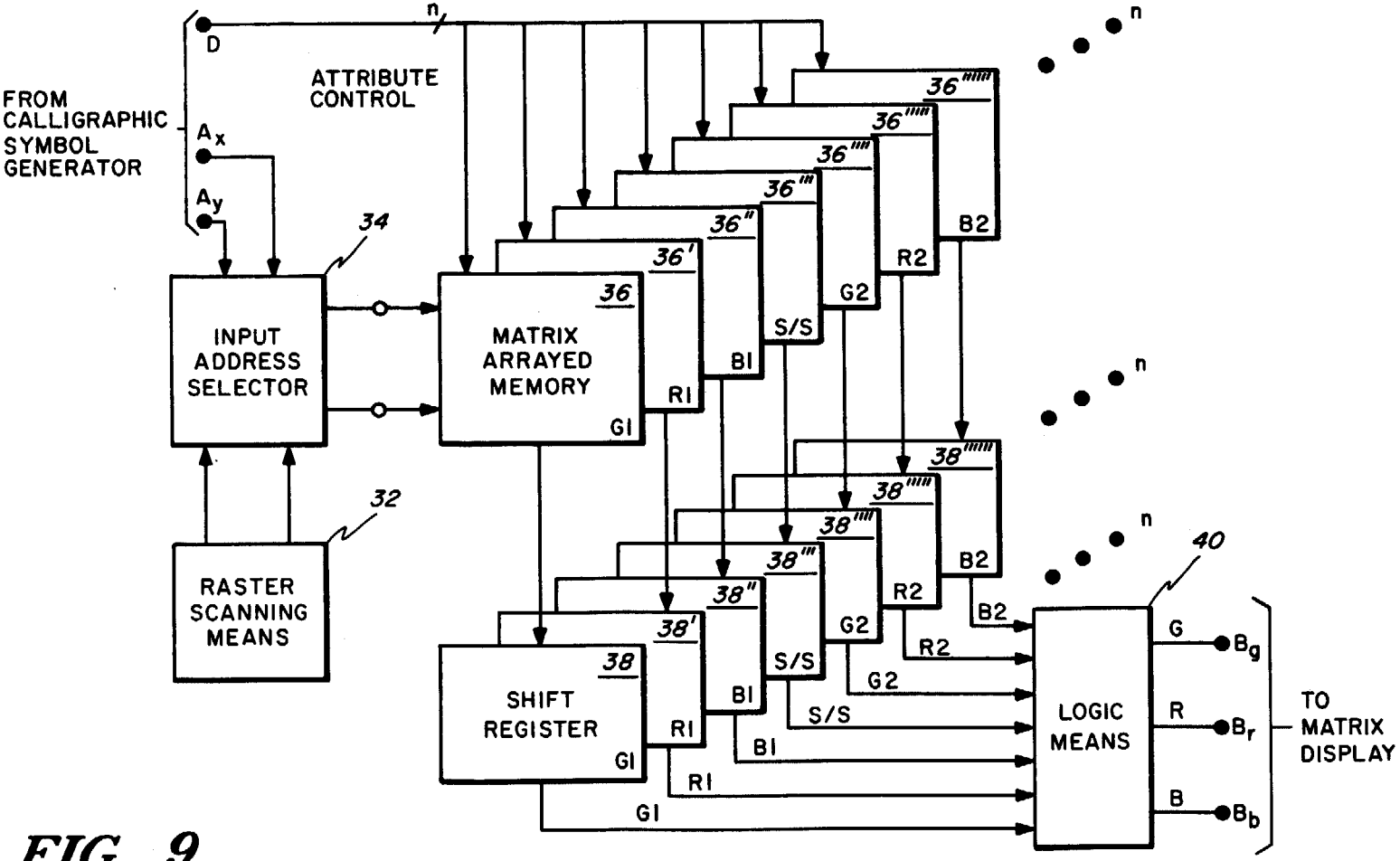
FIG. 9 shows in block form a modification of the diagram of FIG. 6 wherein a plurality of matrix arrayed memories and corresponding video shift registers are provided along with the necessary logic circuits for allowing a multicolor display, for displaying shades of gray, and for allowing a priority ordering of symbols wherein symbols of higher priority will overlay intersecting portions of symbols of lower priority.

As seen in FIG. 9, there is provided a plurality of matrix arrayed memories 36, 36', 36'', . . . and a plurality of corresponding video shift registers 38, 38', 38'', . . . for the purpose of effecting multicolor video signal outputs and shades of gray video signal outputs. Matrix arrayed memories 36, 36', 36'', . . . receive color, priority, and symbol-fill attributes from attribute register 28 of FIG. 2. Attribute register 28 is provided for storing and outputting color, priority, and symbol-fill attributes to be provided to the parallel matrix arrayed memories 36, 36', 36'', . . . for effecting color, priority, and symbol-fill attributes of the symbol stored in the respective matrix arrayed memories. Logic means 40 are provided for determining the color, priority, and symbol-fill and gray shades symbology according to the state of the data received from video shift registers 38, 38', 38'', . . . , the output of the logic means 40 being provided to the matrix display 10.

Figure 11:
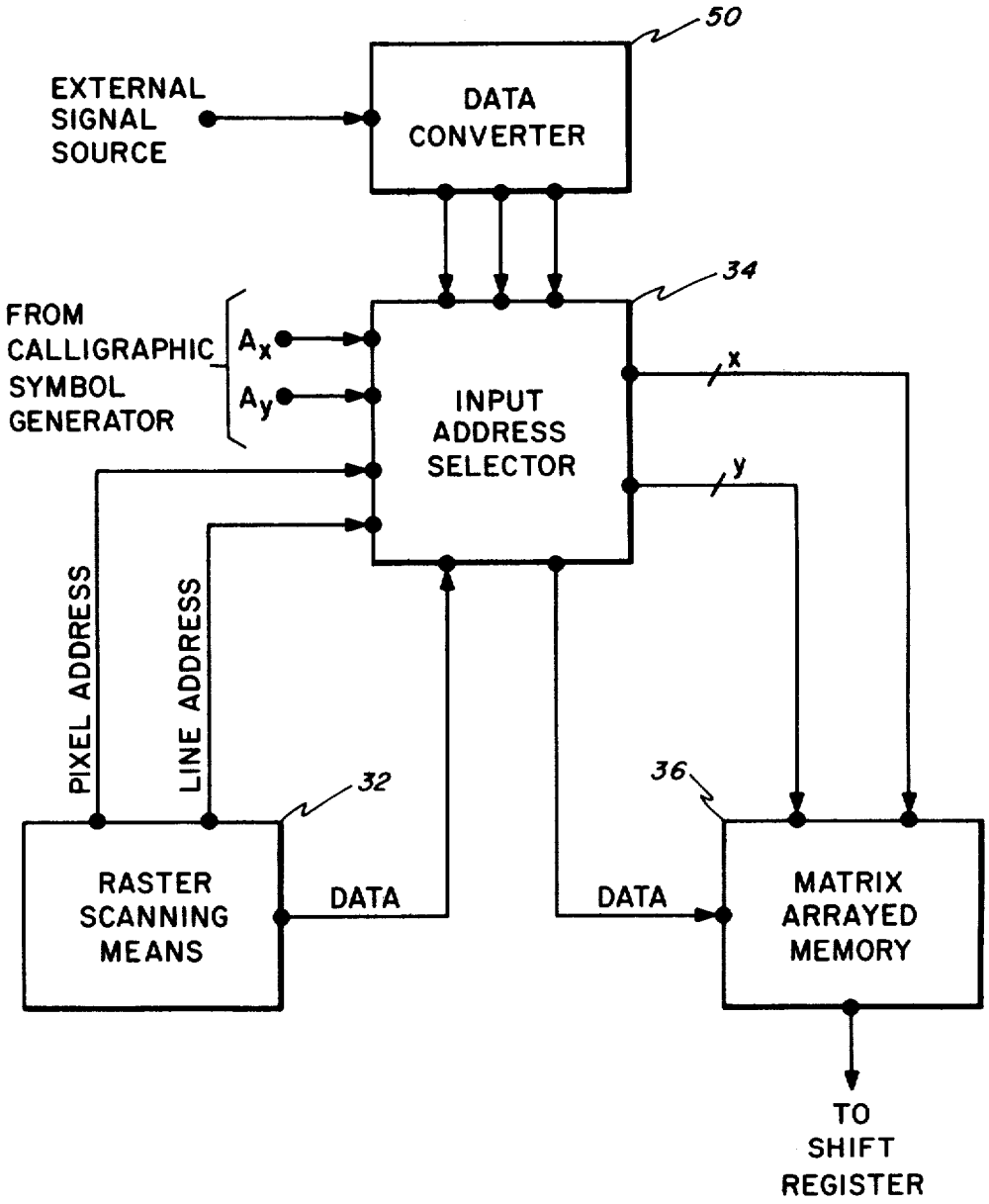
FIG. 11 shows in block form a modification of the raster image buffer of FIG. 6 wherein means are provided for receiving and processing an external signal source representing real time and reconstituted imagery.
Figure 12:
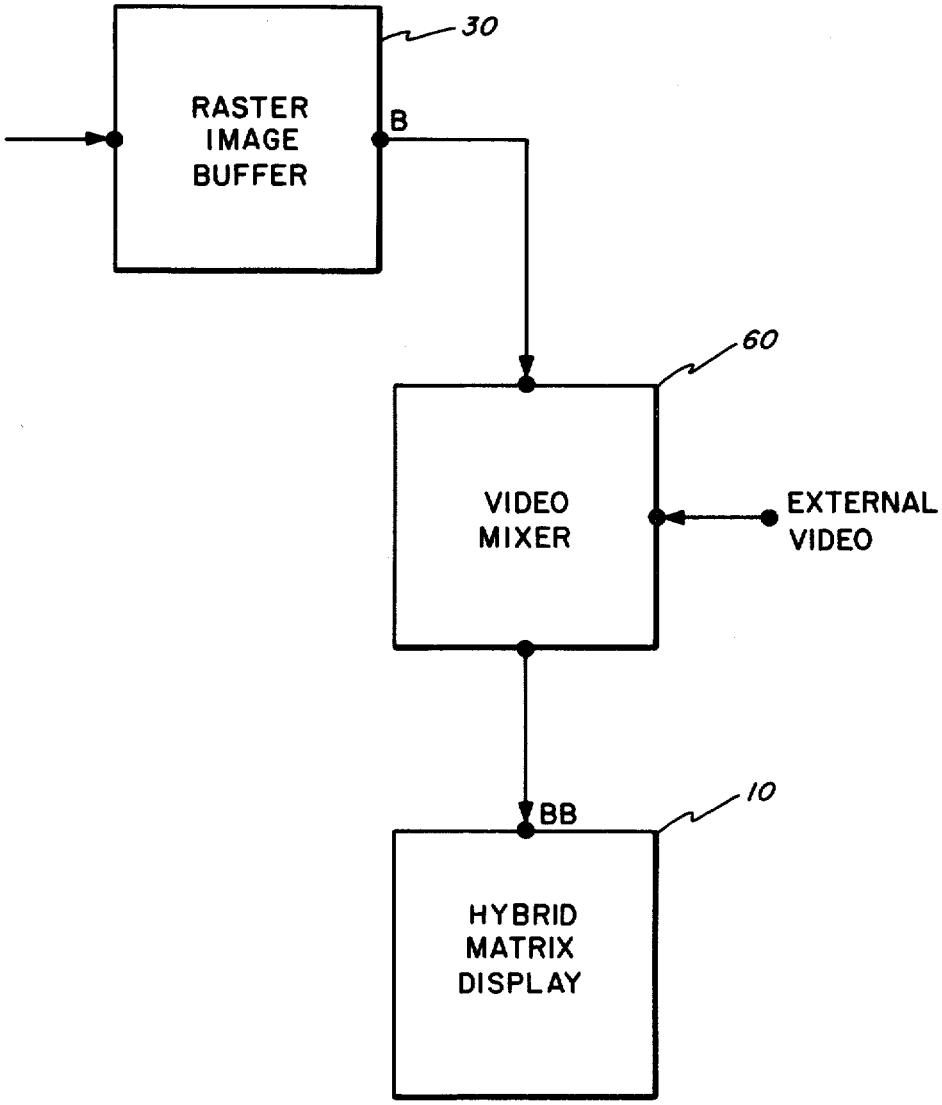
FIG. 12 shows in block form an alternate arrangement for receiving and processing an external video signal.

In another aspect of the invention, there is further provided means for inputting into the raster display system externally generated signals representing real time imagery and/or reconstituted imagery. In one form of the preferred embodiment, and as seen in FIG. 11, such includes a data converter 50 receiving the external signals and supplying converted addresses to the raster image buffer 30 through the input address selector 34. In another form of the preferred embodiment as seen in FIG. 12, the means for inputting includes a video mixer 60 placed in circuit serially between the raster image buffer 30 and matrix display 10.

A detailed description of the operation of the invention will now be presented.

The calligraphic symbology generator 20 of FIG. 1 employs as seen in FIG. 2, digital processing capability, input circuitry to receive information from various sources, memory in which input information is temporarily stored while being processed by the processor, and an output from the digital processor to variable memory 223. The processor is adaptable by software to the requirements of the application of the system. It may receive various types of digital, analog, or discrete input signals. Digital processor 23 will, according to preprogrammed instructions, process this input information and add to it any internal information before putting it in the variable memory store 223. This processing may affect a symbol's position; orientation with respect to a point upon the display, or within the symbol itself; its gray shade; color; line segment modulation; priority; shape; line and surface edge smoothing; or a host of other attributes that may be applicable to the symbol. The processor may also be used to control the display system parameters and indicate malfunctions. Such parameters include the display refresh rate (or how many times the display image is generated in a given time interval), the display data update rate (or how many times the data that affects the display's image is computed in a given time interval), the display resolution (such as 525, 875, 1024 . . . raster lines with a raster frame), the interlacing of raster lines, display declutter functions, fault procedures when malfunctions occur, and other such types of control functions.

Data placed into the variable memory 223 may be in the form of processed dynamic data or fixed data that will affect a symbol, or a list of display instructions that will affect control of the program memory and hence the display symbology. This information can be placed in the variable memory 223 in predefined memory locations or queued beginning at any given memory location. The controller 27 will receive its instruction from any of the three memories within the digital memory 22. The source of instructions is transparent to the controller. It is normally controlled by instructions residing in the program memory 221; however these instructions may give control over to instructions residing in the variable memory 223 or the symbol library memory 222 at any point in the program. Likewise, control can be given back to the program memory 221 at any point in the program.

This transparency of display instruction sources allows flexiblity in that, besides responding to instructions contained within its program memory 221, the controller 27 can respond to instructions placed in the variable memory 223 from an external source. This external source can be any source that interfaces through I/O to the digital processor 23.

The controller 27 interprets the display instructions and executes them according to the instruction op-code. For example, the interpretation of a position instruction that contains the X-coordinate position value causes the controller 27 to generate a load command to the X-digital integrator 242 that commands the integrator 242 to accept the data (X-position value in this case) that is present on digital data bus 2. Once these data are loaded into the digital integrator 242, they are outputted to the X-address input of the RIB 30 and the DAC 243 of the X-stroker 24. Thus, the data simultaneously affect the calligraphic portion and the raster portion of the display generator.

FIG. 3 contains a partial but basic list of display instructions that are executable in this display generating system. The program residing in memory 22 is composed of mixtures of these instructions queued to allow successive symbols composed of successive symbol line segments to be generated. A typical memory map that may be programmed is set forth in FIG. 4. Initialization instructions are shown beginning at location 0 of the program memory 221. The remainder of the program memory is filled with: format routines (each routine defines a display format); symbol subroutines (that can define any desirable symbol); and special subroutines (that may simplify programming or perform a special requirement such as rolled symbols).

The variable memory 223 will contain data that are entered from the central processor 23. These data may contain: special symbol subroutines; special formats supplied from the data processor (these may be trial or test formats); dynamic data (that will be fetched, as required, during the execution for format or subroutine instructions); and a pointer that may select any format routine (stored in either the variable 223 or program memory 221).

This is not a required memory map. Any map arrangement may be utilized at the convenience of the programmer. There may be certain desirable arrangements, however, such as the location of the ASCII conversion table. It is not necessary that a pointer instruction be contained in the variable memory. This particular map shows an arrangement that is used for multimode operation where a different format is required for each phase of a mission scenario. If a single fixed format is desired, then the pointer can be eliminated. The DG initialization routine may jump directly into the desired format routine.

Figure 4:
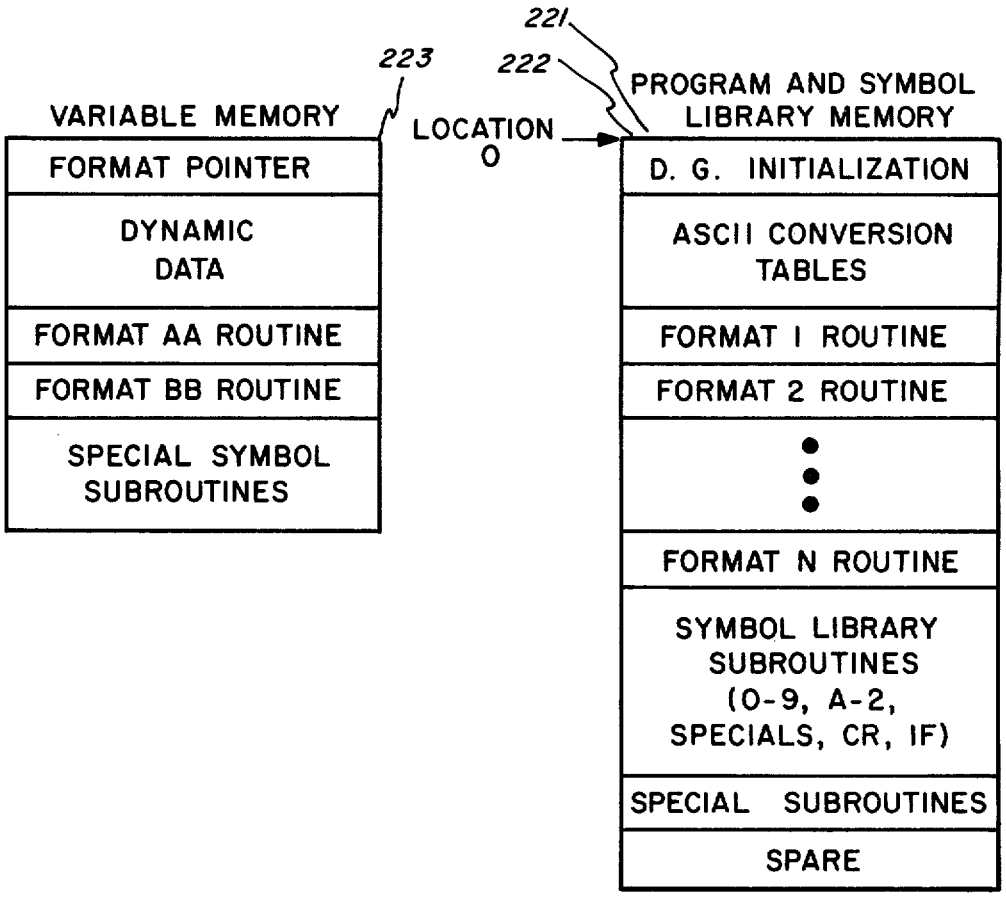
FIG. 4 is a chart showing the memory map of portions of the digital memory of the calligraphic symbology generator of FIG. 2.

The program memory 221 and the symbol library memory 222 are shown separately in FIG. 2; however, this does not preclude combining them for simplification purposes as inferred in FIG. 4.

Referring to FIG. 3, the position instructions (POSX, POSY) are used for positioning the symbol, the slope and segment length instructions (STRX, STRY, SEGL) for generating the symbol, the attribute instruction (DISC) for affecting the symbol's appearance, and branch instructions (JMP, JMS, RTN, NOP) for branching to and returning from other routines or subsoutines. The main purpose of the attribute instruction is to affect symbol appearance; however, a subset of attribute instructions is used to provide control instructions to the controller 27.

A sample display listing showing branching to generate the word "NOW" is:

| | |
|---|---|
| POSX | |
| | location of first character |
| POSY | |
| JMS N | (address of character N) |
| JMS O | (address of character O) |

-continued

| | |
|---|---|
| JMS W | (address of character W) |

A sample listing to generate an equilateral triangle might be:

| | |
|---|---|
| SEGL | (length of side) |
| STRX | |
| | (slope of segment 1) |
| STRY | |
| STRX | |
| | (slope of segment 2) |
| STRY | |
| STRX | |
| | (slope of segment 3) |
| STRY | |

For each segment of a generated symbol, the X and Y values of the segments' slopes are entered into registers 241 and 251, respectively (see FIG. 2). The length of the segment is entered into the segment length counter 26. Segment stroking commences. When the segment length attains that length which was entered into the segment length counter 26, counter 26 notifies the controller 27 which then addresses memory 22 for the next set of instructions. This process continues for the duration of the display refresh, refreshing each symbol displayed on a segment by segment basis. When all of the symbols within the programmed image are refreshed, an attribute instruction puts the controller 27 in an "idle-state" where it remains until the beginning of the next refresh period. This next period is commenced by a "start signal" from the digital processor 23 to the controller 27 by a discrete signal not shown in these figures.

As all symbology is stroked according to the initial positioning and the integration rate of the digital integrators 242 and 252, and as it is outputted to the display in calligraphic form through the digital-to-analog converters (DACS) 243 and 253, and as it is outputted to the display in raster matrix form through the RIB 30, the generated symbology can be displayed in both calligraphic and raster form, simultaneously.

Further, as the calligraphic outputs from the digital integrators 242 and 252 through the DACS 243 and 253 to the display, and the acceptance of the digital integrator outputs by the RIB 30 are controlled by the controller 27, the system can be software programmed to select any portion of the symbology to be calligraphically displayed or raster matrix displayed on the display device 10.

Further, the control just described allows the refresh of a display entirely in calligraphic form for daylight viewing and in raster form for viewing under low levels of ambient brightness. In this latter case, external video from other sources is easily mixed with the generated video, as described above, to allow the superposition of the images from both sources of video on the display 10, as shown in FIG. 12.

Figure 5:
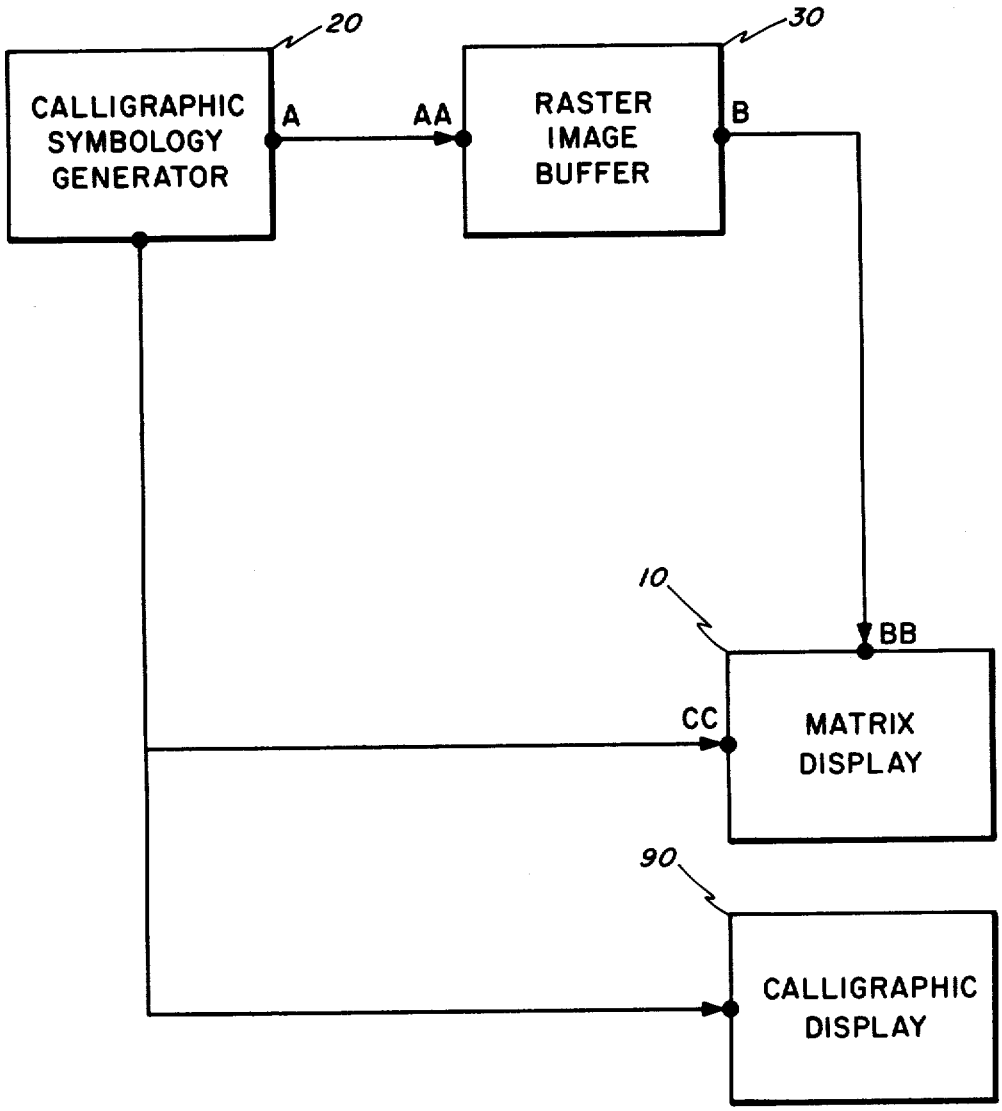
FIG. 5 shows in block form an alternate arrangement of FIG. 1 wherein a calligraphic display is also provided.

Further, this control allows the simultaneous generation and presentation of raster video upon one display 10, and calligraphic stroking on another display 90 as shown in FIG. 5. The control allows all or only portions of the symbology within the image to be shown on either display 10 or 90.

Figure 7:
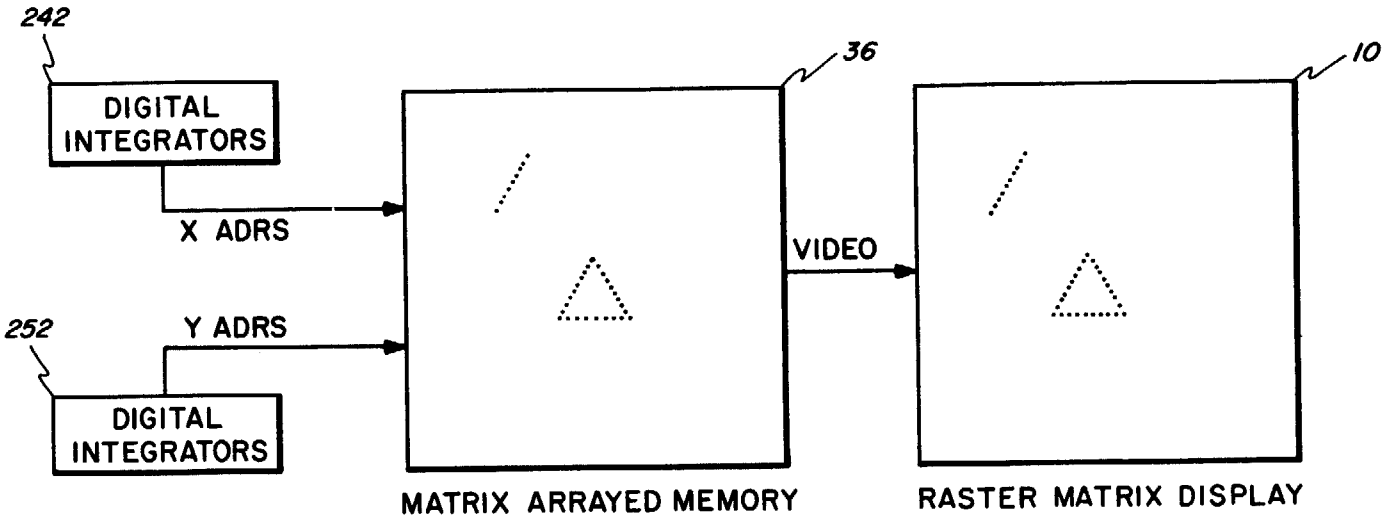
FIG. 7 shows the 1:1 correspondence between pixels on the raster matrix display and the memory cell locations within the matrix arrayed memory.

The circuits of the raster image buffer 30 are illustrated in FIG. 6. It employs a matrix arrayed memory (MAM) 36 that has the capacity to store an entire raster image; an output shift register 38 that functions to read MAM 36 in synchronism with the raster sweep timing; a raster scanning means 32 that provides timing to the output shift register and pixel and line addressed to the MAM 36 through the input address selector 34 (raster scanning means 32 also provides means 324 to generate the raster sweep signals (in a digital or analog form) or synchronization pulses by which a sweep generator will be synchronized); and an input address selector 34 that selects MAM 36 addresses from either the raster scanning means (for read out) or from the calligraphic symbol generator 20 (to read information into the MAM 36). As shown in FIG. 7, the matrix arrayed memory 36 contains a memory map of the image that will appear on the raster matrix display 10. For each pixel within the raster matrix display 10, there is a corresponding memory cell in the matrix arrayed memory 36 (This does not preclude combinations that may reduce memory size for certain high resolution displays. Such combinations could allow one memory cell for a group of adjacent display pixels).

Referring to FIG. 6, symbology is sequentially stroked into the matrix arrayed memory 36 by addressing its X and Y address lines. These X and Y addresses are supplied by the X and Y digital integrators 242 and 252 (FIG. 2) when the input addresses are accepted by the selector 34, as controlled by the raster scanning means 32. This allows symbology to be entered into the matrix arrayed memory 36 during the sweep flyback intervals or during any time interval that is compatible with display timing. This timing control is also under the control of the digital processor 23.

Coincident with raster sweeps, the display information is read out of the matrix arrayed memory 36 and into the output shift register 38. This occurs on a raster line basis. At the beginning of each raster line sweep, a complete line of raster information that corresponds to the raster line to be generated upon the display 10 is loaded into the shift register 38. This information is then shifted out of the shift register 38 at a rate that corresponds to the pixel rate of the raster line sweep. This is controlled by the raster scanning means 32. During this readout, the input address selector 34 selects only the line addresses generated by the raster scanning means 32.

In order to reduce hardware complexity, portions of the raster line information may be read out from the matrix arrayed memory 36, instead of an entire raster line, and loaded into the shift register 38. This is "on the fly read out" and is the preferred method. This requires timing alterations and the inclusion of pixel addressing.

The data within the matrix arrayed memory 36 must at times be erased, otherwise it would fill with symbology and the display would become indiscernable. Various methods are devised to do this. Four methods are presented here. Method 1 entirely erases the memory 36. It employs a timing scheme whereby every $i^{th}$ refresh cycle ($i=1,2,3,\ldots$) the raster scanning means 32 will cause an "ERASE" signal to be active for an entire refresh period. During this period, the memory 36 employs a read-modify-write sequence every time it is addressed. The sequence will first read the contents of the raster line information from the addressed memory cells and store it in the shift register 38. Then a write cycle will occur that will write "zeroes" into the addressed memory cells, effectively erasing those addressed memory cells. As this sequence continues for the refresh of the entire raster frame, the entire matrix arrayed memory 36 is erased. With the memory entirely erased, it is available to stroke in new symbology without regard to the previous contents of the memory 36. If viewable flicker of the display is to be prevented (it is sometimes allowed) the information within the memory 36 must immediately be restored, before the next refresh period. Method 2 erases the symbology within the matrix arrayed memory 36 that has apparent motion to the viewer of the display 10. To achieve the effect of symbol motion, matrix arrayed memory cells corresponding to display pixels are erased and new adjacent cells are activated. Thus, the memory cells that correspond to the symbol's new position must be activated (set to logic "ones") and the cells that correspond to the symbol's old position must be erased (cleared, or set to logic "zeroes"). This movement occurs on a raster frame basis: on one raster frame period the symbol will appear at a specific position (or be defined by specific raster pixels) and on succeeding raster frames the symbol will appear at neighboring positions (or at neighboring pixels). To erase the pixels that define the old position of a symbol, that symbol is stroked into the matrix arrayed memory 36 again at its old position, but rather than setting the cells to logic "one" states, the cells are cleared by setting their states to logic "zeroes". The symbol thus has been selectively removed from the memory. It can be left in this removed state, or it can be stroked in again. If it is a moving symbol, it would be stroked in again to the matrix arrayed memory cells that correspond to its new position. Method 3 is a combination of methods one and two. When initializing the display system or at anytime the display image is to be removed, such as when switching modes of operation, the complete erasure as described in method one is used. When only selective symbol erasure is desired, the erasure of method two is used. Method 4 is also a combination of methods one and two. This method is used when a portion of the display is erased entirely and another portion of the display is erased selectively. The erasure method of method one is used to erase only the line or pixel sections that are entirely erased and the erasure method of method two is used to erase selectively the symbols within the other portions of the display. The necessary signals to control these functions (DATA, and READ/WRITE CONTROL) of FIG. 6 are from the attribute control register 28 (FIG. 2) and from the raster scanning means 32.

To maximize symbol capacity, two matrix arrayed memories 36 and 37 may be employed as shown in FIG. 8. One memory is used to refresh the display while the other is being updated. In synchronism with the raster refresh timing signals from the raster scanning means 32, the memory's roles are reversed. The ping-ponging of these memories may be at the field rate or some multiple of the field rate, depending upon the system requirements. When one matrix arrayed memory (36) is used for refreshing, its corresponding input address selector (34) selects the addressing and control signals from the raster scanning means 32. The output selector 39 selects this matrix arrayed memory's output for loading into the shift register 38. When being updated, its input address selector selects the input addressing and control from the calligraphic symbol generator 20. This scheme allows more time to erase a matrix arrayed memory 36 or 37 and to load in new symbology.

FIG. 9 illustrates multiple planes 36, 36', 36'', 36''', . . . of the matrix arrayed memory 36 for purposes of stroking in and reproducing in raster matrix video form, symbology that contains color and luminance information, symbols whose lines of construction are edge smoothed, symbols of ordered priority that will give the appearance of ordered overlay of intersecting symbols or portion of symbols, and filled symbols. These matrix arrayed memory planes 36, 36', 36'', 36''', . . . have assigned functions. The assignment of these functions is arbitrary and is dependent upon the attribute control structure and the logic means 40. The diagram of FIG. 9 defines one such assignment of the memory planes 36, 36', 36'', . . . and will be described.

When a symbol, or line segment of a symbol, is stroked by the calligraphic symbology generator 20, these symbols or line segments can selectively be stroked into any or all of the matrix arrayed memory planes 36, 36', 36'', 36''', . . . . When reading out the information within these matrix arrayed memories 36, 36', 36'', 36''', . . . during refresh, the logic means 40 will determine the symbol's characteristics of attributes according to the symbology information in each one of the memory planes 36, 36', 36'', 36''', . . . .

In this particular embodiment, the assignment of the memory planes 36, 36', 36'', 36''' . . . and their corresponding shift registers 38, 38', 38'', 38''' . . . are assigned green 1 (G1), red 1 (R1), blue 1 (B1), start/stop (S/S), green 2 (G2), red 2 (R2), blue 2 (B2), . . . , respectively. This sequence can continue with additional assignments according to the required attributes of the symbology, the advantages of which will become apparent in the following descriptions.

Figure 10:
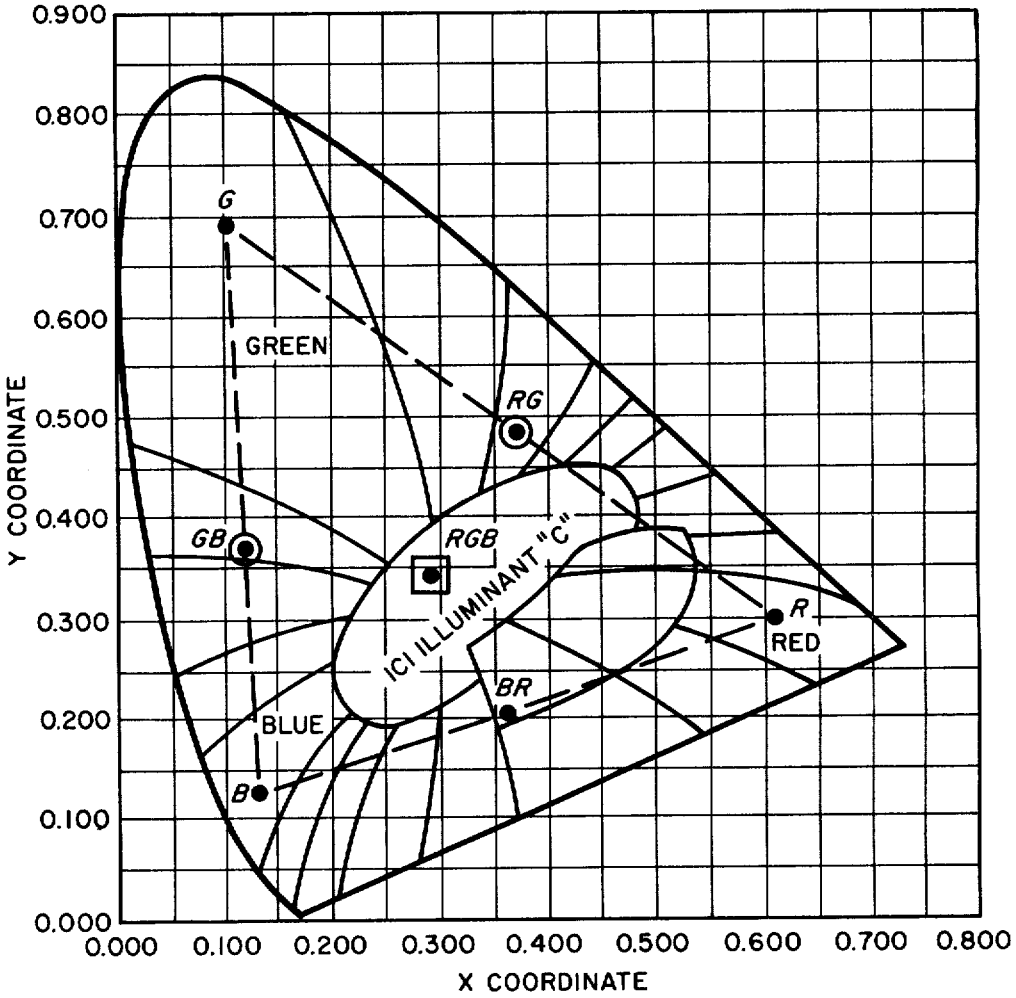
FIG. 10 is a phosphor chromaticity diagram of a typical 3-base color CRT.

The first three memory planes 36, 36', and 36'' define symbol color. If a symbol or line segment is stroked into memory plane 36, it will be produced on the hybrid matrix display 10 (3-base color CRT) in green. If stroked into memory plane 36' or 36'', it will be produced on the display 10 in red or blue, respectively. If stroked into more than one of these memory planes, 36, 36', 36'', then it will be produced on the display 10 in the color or hue that occurs when these base colors are mixed. These color mixtures are indicated on the phosphor chromaticity chart of FIG. 10. The base colors are designated G, R and B. These are the base colors that correspond to matrix arrayed memory planes 36, 36', and 36'', respectively. The mixtures or hues available by mixing the colors are designated RG, GB, and BR. If the symbol is stroked into all three memory planes, 36, 36', 36'', the symbol will be produced with a mixture of green, blue and red, marked RGB on the diagram of FIG. 10, and would appear white to the observer.

To achieve this mixing of symbol color for each pixel requires a line synchronous, pixel synchronous readout of the matrix arrayed memory planes 36, 36', 36'', and the corresponding shift registers 38, 38', 38''. The logic means 40 provides the combinatorial logic to mix the signals from the shift registers 38, 38', 38'', and output the color information to hybrid matrix display 10 on a pixel by pixel basis.

Expansion of this scheme to obtain various luminance levels and more hues includes adding additional memory planes. By adding memory planes 36'''', 36''''', 36'''''' and defining them as green 2, red 2, and blue 2 (note: the terms G2, R2, and B2 will be used to denote the memory planes 36'''', 36''''', 36'''''' and their corresponding shift registers 38'''', 38''''', 38'''''', respectively) the output signals from these memories and registers will be combinatorially combined in the logic means 40 to affect further the color circuits of the hybrid matrix display 10 to produce the symbols in combinations of the color and luminance ratios available from these three signals G2, R2, B2 when combined with the color signals G1, R1, B1.

There are 64 combinations of hues and luminance levels obtainable from these six signals that are plottable on a chromaticity diagram. All of these color mixtures would be contained on or within the defining triangle GRB shown in FIG. 10.

As these signals G1, R1, B1, and G2, R2, B2 can represent gray shades instead of color, the logic means includes a digital to analog converter (DAC) to convert these digital signals to a multilevel analog signal that produces the symbols on the hybrid matrix display 10 in shades of gray. When this option is used, the analog signal is available on any one or all of the G, R, or B signals outputted from the logic means 40.

Symbol priority determines which symbol will dominate, or be displayed when symbols or portions of symbols intersect or overlap each other. If hypothetical symbol A has a higher priority than hypothetical symbol B, then symbol A will appear to be closer to the viewer and will cover up the portions of symbol B that are overlapped by symbol A. The priority of the symbol can be assigned by additional matrix arrayed memory planes and shift registers, or the priority of the symbol may be assigned by its color or gray shade. If assigned by its color or gray shade, the signals G1, R1, B1, and any additions such as G2, R2, B2 would be used. Priority is determined by the logic means 40 during readout according to a predefined order. It functions to pass only the symbol line segments, or portions thereof, whose priority code formed by the input signals of R1, B1, G1 (or signals from additional matrix arrayed memory planes and their corresponding shift registers) is greater than that of the intersected symbol line segments, or portions thereof.

A symbol is defined by a group of line segments. If these line segments form a closed geometric shape, or a polygon, then the raster image buffer 30 can, under attribute control, fill in the polygon with a gray shade or color. To fill the polygon, only the leading edges of the polygon are stroked into the S/S matrix arrayed memory 36'''. As information for each raster line is read out of the matrix arrayed memory planes and their associated shift registers, on a pixel by pixel basis, one of a plurality of flip-flops within the logic means 40 will be set if there exists a coincidence between the S/S signal and one or more of the other signals B1, R1, G1, B2, R2, G2, . . . . The particular flip-flop, of the plurality of flip-flops that will be set, will depend upon which of the other signals B1, R1, G1, B2, R2, G2, . . . are active. These other signals will be used to form a code that will define the color or gray shade of the symbol and set the flip-flop according to that code. The flip-flop then remembers the color or gray shade of the symbol at the leading edge of the symbol, as it appears on a given raster line, and passes this color or gray shade code to the other circuitry (such as priority) within the logic means 40. It does this on a raster line-by-line basis. As the trailing edges of the polygon are not stroked into the S/S plane, readout of these trailing edges of the symbol has the same code but no corresponding activated cell in the S/S plane. This condition then resets the flip-flop and ends the symbol-fill for that given raster line. Thus the symbol is filled with the symbol color or gray shade as remembered by the flip-flop for the portion of the raster line for which it was set. This corresponds to the leading and trailing edge of the symbol as it was stroked into the RIB 30 by the calligraphic symbol generator 20. As the circuitry within the logic means 40 processes symbol-fill before priority, the resultant symbol-filled areas will behave in the ordered way just described for priority.

FIG. 11 illustrates the ability of the system to accept, convert, and display information from external sources. Such sources include weather radar, track radar, search radar, electro-optical scanner type sensors, and other sources that provide information which can be converted into raster matrix form for display on a hybrid raster matrix type display. The information to be displayed is first received by the data converter 50 for processing into a form acceptable by matrix arrayed memory 36. This includes changing the input information into Cartesian (X and Y) address and color or gray shade data for addressing the memory planes within the matrix arrayed memory 36.

This form of the embodiment requires expanding the input address selector 34 to allow the selection of this third set of inputs to the matrix arrayed memory 36.

The data converter 50 is equipped to convert data that is inputted from the external signal source in a polar coordinate ($R\theta$) form that defines the range and azimuth of radar signal returns and the signal return strength or level. This data converter 50 processes the data, in digital form, to convert the received polar coordinate data to Cartesian address (X and Y) form for addressing the matrix arrayed memory 36. Concurrent with this address conversion, the data converter is also coding the radar signal returns into color or gray shade codes that will define the color or gray shade of the pixel addressed by the converted address. In actuality, this conversion may include one or a plurality of display pixels for each conversion of the received information.

For signals from the external signal source that are in electrical analog form, a set of analog to digital converters within the data converter 50 converts the analog signals into digital form for further processing.

Electro-optical (EO) sensors are composed of an in-line array of sensors. This array is scanned across a given field of view generating lines of video data. This external signal source requires that the data converter convert these EO lines and video levels for each given scan line into addresses and color or gray shade codes for entry into the matrix array memory.

The video mixer 60 of FIG. 12, allows the output from the raster image buffer 30 to be mixed with an external video signal for the superposition of symbology on the image supplied by the external video source. In doing this, the video mixer 60 contains circuitry that restores video levels to insure the correct mixture of signals from the two sources. It further includes circuitry that blanks out, or removes, the external video signal and substitutes the symbology from the raster image buffer 30 as each symbol occurs in the video from the raster image buffer 30. A further function of the video mixer 60 is to separate out synchronization signals from the external video and supply these synchronization signals to the raster scanning means 32 for synchronizing the raster display generating system to the timing of the external video. The video mixer 60 is controlled by a signal (not shown) from the attribute register 28 of FIG. 2 to allow selection of these functions, the functions being: the mixing of external video, the synchronization of the raster display generating system to external video timing, the display only of video from the raster image buffer 30, and the display only of external video.

It will be apparent to those skilled in the art that various modifications and variations may be made in the system of the invention and the method in which it is employed without departing from the true spirit and scope of the invention.

What is claimed is:

1. A raster display generating system having means for converting calligraphic symbology information into raster scanned symbology, comprising, in combination:

a raster scanned matrix display for displaying information to an observer, the matrix display having an input for receiving raster scanned video signals;

a calligraphic symbology generator for converting information to be displayed on the matrix display into calligraphic symbology by stroking complete symbols, at least one symbol making up a complete display image, the generator having an output; and a raster image buffer having an input for receiving from the generator output calligraphic symbology and for converting the symbology into raster scanned format and for storing for later display on the matrix display, the buffer having an output providing raster scanned video signals to the input of the matrix display.

2. The invention of claim 1 wherein the calligraphic symbology generator further includes a digital memory comprising:

a program memory for calling out a sequence of symbols to be generated;

a symbol library memory for orderly calling out a sequence of line segments defining the symbol being generated; and a variable memory for storing information relating to orientation and movement on the display of each generated symbol.

3. The invention of claim 2 wherein the calligraphic symbology generator further comprises a digital processor for feeding information to the variable memory for effecting movement and change of orientation of the generated symbols.

4. The invention of claim 2 wherein the calligraphic symbology generator further includes:

a first digital stroker for receiving the X-coordinate value of the line segment of a symbol being generated and for providing an X-address in digital form for addressing the raster image buffer; and a second digital stroker for receiving the Y-coordinate value of the line segments of a symbol being generated and for providing a Y-address in digital form for addressing the raster image buffer.

5. The invention of claim 4 wherein the first and second digital strokers each include:

a register for storing the respective coordinate values and a digital integrator for integrating the values, the output of which for each value is the displayed symbol segment.

6. The invention of claim 2 wherein the calligraphic symbology generator further comprises:

a segment length counter receiving an input from the digital memory for defining the length of the current symbol segment and having an output; and a controller receiving the output from the segment length counter to effect addressing the program memory for the next instruction.

7. The invention of claim 1 wherein the raster image buffer comprises:

raster scanning means for providing timing information and pixel and line addressing information;

an input address selector for receiving the output from the calligraphic symbology generator and timing and addressing information from the raster scanning means for providing output addresses;

a matrix arrayed memory receiving the output addresses from the input address selector for effecting addressing of individual memory elements within the matrix arrayed memory and providing an output which is a line-by-line composite of the raster image; and a shift register for receiving the output from the matrix arrayed memory and timing information from the timing means and for orderly presenting each pixel of an image on each raster line to the matrix display in the form of raster scanned matrix video signals.

8. The invention of claim 7 wherein there is provided a plurality of parallel matrix arrayed memories and a plurality of corresponding video shift registers for effecting multicolor video signal outputs.

9. The invention of claim 7 wherein there is provided a plurality of parallel matrix arrayed memories and a plurality of corresponding video shift registers for effecting shades of gray video signal outputs.

10. The invention of claim 8 wherein:

the calligraphic symbology generator is further provided with an attribute register for storing and outputting color, priority, and symbol-fill attributes;

the parallel matrix arrayed memories receive respectively the color, priority, and symbol-fill attributes from the attribute register for effecting color, priority, and symbol-fill attributes of the symbols stored in the respective matrix arrayed memories; and logic means for determining the color, priority, and symbol-fill symbology according to the state of the data received from the video shift registers.

11. A system for converting calligraphic symbology into raster scanned symbology for feeding into a raster scanned matrix display, comprising, in combination:

a calligraphic symbology generator for converting information to be displayed on the matrix display into calligraphic symbology by stroking complete symbols, at least one symbol making up a complete display image, the generator having an output; and a raster image buffer having an input for receiving from the generator output calligraphic symbology and for converting the symbology into raster scanned format and for storing for later display on the matrix display, the buffer having an output providing video signals adapted for feeding to the matrix display.

12. The invention of claim 11 wherein the calligraphic symbology generator further includes a digital memory comprising:

a program memory for calling out a sequence of symbols to be generated;

a symbol library memory for orderly calling out a sequence of line segments defining the symbol being generated; and a variable memory for storing information relating to orientation and movement on the display of each generated symbol.

13. The invention of claim 12 wherein the calligraphic symbology generator further comprises a digital processor for feeding information to the variable memory for effecting movement and change of orientation of the generated symbols.

14. The invention of claim 12 wherein the calligraphic symbology generator further includes:

a first digital stroker for receiving the X-coordinate value of the line segment of a symbol being generated and for providing an X-address in digital form for addressing the raster image buffer; and a second digital stroker for receiving the Y-coordinate value of the line segments of a symbol being generated and for providing a Y-address in digital form for addressing the raster image buffer.

15. The invention of claim 14 wherein the first and second digital stroker each include:

a register for storing the respective coordinate values and a digital integrator for integrating the values, the output of which for each value is the displayed symbol segment.

16. The invention of claim 12 wherein the calligraphic symbology generator further comprises:

a segment length counter receiving an input from the digital memory for defining the length of the current symbol segment and having an output; and a controller receiving the output from the segment length counter to effect addressing the program memory for the next instruction.

17. The invention of claim 11 wherein the raster image buffer comprises:

a raster scanning means for providing timing information and pixel and line addressing information;

an input address selector for receiving the output from the calligraphic symbology generator and timing and addressing information from the raster scanning means for providing output addresses;

a matrix arrayed memory receiving the output addresses from the input address selector for effecting addressing of individual memory elements within the matrix arrayed memory and providing an output which is a line-by-line composite of the raster image; and a shift register for receiving the output from the matrix arrayed memory and timing information from the timing means and for orderly presenting each pixel of an image on each raster line to the matrix display in the form of raster scanned matrix video signals.

18. The invention of claim 17 wherein there is provided a plurality of parallel matrix arrayed memories and a plurality of corresponding video shift registers for effecting multicolor video signal outputs.

19. The invention of claim 17 wherein there is provided a plurality of parallel matrix arrayed memories and a plurality of corresponding video shift registers for effecting shades of gray video signals outputs.

20. The invention of claim 18 wherein:

the calligraphic symbology generator is further provided with an attribute register for storing and outputting color, priority, and symbol-fill attributes;

the parallel matrix arrayed memories receive respectively the color, priority, and symbol-fill attributes from the attribute register for effecting color, priority, and symbol-fill attributes of the symbols stored in the respective matrix arrayed memories; and logic means for determining the color, priority, and symbol-fill symbology according to the state of the data received from the video shift registers.

21. A raster display system including means for converting calligraphic symbology information into raster scanned symbology, comprising, in combination:

a raster scanned matrix display for displaying information to an observer, the matrix display having an input for receiving raster scanned video signals;

a calligraphic symbology generator for converting information to be displayed on the matrix display into calligraphic symbology by stroking complete symbols, at least one symbol making up a complete display image, the generator having an output;

a raster image buffer having an input for receiving from the generator output calligraphic symbology and for converting the symbology into raster scanned format and for storing for later display on the matrix display, the buffer having an output providing raster scanned video signals to the input of the matrix display; and means for inputting into the system externally generated signals representing real time and reconstituted imagery.

22. The invention of claim 21 wherein the calligraphic symbology generator further includes a digital memory comprising:

a program memory for calling out a sequence of symbols to be generated;

a symbol library memory for orderly calling out a sequence of line segments defining the symbol being generated; and a variable memory for storing information relating to orientation and movement on the display of each generated symbol.

23. The invention of claim 22 wherein the calligraphic symbology generator further comprises a digital processor for feeding information to the variable memory for effecting movement and change of orientation of the generated symbols.

24. The invention of claim 22 wherein the calligraphic symbology generator further includes:

a first digital stroker for receiving the X-coordinate value of the line segment of a symbol being generated and for providing an X-address in digital form for addressing the raster image buffer; and a second digital stroker for receiving the Y-coordinate value of the line segments of a symbol being generated and for providing a Y-address in digital form for addressing the raster image buffer.

25. The invention of claim 24 wherein the first and second digital strokers each include:

a register for storing the respective coordinate values and a digital integrator for integrating the values, the output of which for each value is the displayed symbol segment.

26. The invention of claim 22 wherein the calligraphic symbology generator further comprises:

a segment length counter receiving an input from the digital memory for defining the length of the current symbol segment and having an output; and a controller receiving the output from the segment length counter to effect addressing the program memory for the next instruction.

27. The invention of claim 21 wherein the raster image buffer comprises:

raster scanning means for providing timing information and pixel and line addressing information;

an input address selector for receiving the output from the calligraphic symbology generator and timing and addressing information from the raster scanning means for providing output addresses;

a matrix arrayed memory receiving the output addresses from the input address selector for effecting addressing of individual memory elements within the matrix arrayed memory and providing an output which is a line-by-line composite of the raster image; and a shift register for receiving the output from the matrix arrayed memory and timing information from the timing means and for orderly presenting each pixel of an image on each raster line to the matrix display in the form of raster scanned matrix video signals.

28. The invention of claim 27 wherein there is provided a plurality of parallel matrix arrayed memories and a plurality of corresponding video shift registers for effecting multicolor video signal outputs.

29. The invention of claim 27 wherein there is provided a plurality of parallel matrix arrayed memories and a plurality of corresponding video shift registers for effecting shades of gray video signal outputs.

30. The invention of claim 28 wherein:

the calligraphic symbology generator is further provided with an attribute register for storing and outputting color, priority, and symbol-fill attributes;

the parallel matrix arrayed memories receive respectively the color, priority, and symbol-fill attributes from the attribute register for effecting color, priority, and symbol-fill attributes of the symbols stored in the respective matrix arrayed memories; and logic means for determining the color, priority, and symbol-fill symbology according to the state of the data from the video shift registers.

31. The invention of claim 21 wherein the means for inputting includes a video mixer connected serially between the buffer and the matrix display.

32. The invention of claim 21 wherein the means for inputting includes an address converter receiving the external signals and supplying converter addresses to the buffer.

33. The invention of claim 27 further comprising:

an address converter receiving the external signals representing real time and reconstituted imagery and supplying converted addresses to the input address selector.

34. A method for converting calligraphic symbology information into raster scanned symbology for display on a raster scanned matrix display comprising the steps of:

generating a consecutive series of X and Y addresses corresponding to the line segments of the symbol being stroked; and converting this consecutive series of addresses into corresponding pixel locations and storing the pixel locations for refreshing the display image at a later time.

35. The method of claim 34 comprising the further step of:

reading out of storage and into the raster scanned matrix display the pixel locations in a raster scanning format.

36. The method of claim 35 wherein the step of converting further includes placing the consecutive series of addresses into corresponding pixel locations in a single memory depth for single intensity level presentation.

37. The method of claim 35 wherein the step of converting further includes placing the consecutive series of addresses into corresponding pixel locations in a plurality of memory depths corresponding to multiple intensity level presentation; whereby the control of memory depth and thereby intensity level is arbitrarily determined for each line segment of a symbol.

38. The method of claim 35 wherein the step of converting further includes placing the consecutive series of addresses into corresponding pixel locations in a plurality of memory depths corresponding to multiple color and multiple intensity level; whereby the control of memory depth and thereby color and intensity level is arbitrarily determined for each line segment of a symbol.

39. The method of claim 35 wherein the step of converting further includes placing the consecutive series of addresses into corresponding pixel locations in a plurality of memory depths corresponding to priority level of the symbol presentation; whereby the control of memory depth and thereby priority level is arbitrarily determined for each line segment of a symbol.

40. The method of claim 37 wherein:

the step of generating further includes generating a consecutive series of X and Y addresses corresponding to the left most line segment of the symbol, in a left to right raster line scan format;

the step of converting further includes placing the consecutive series of addresses into corresponding pixel locations in a first of the plurality of memory depths and of the addresses in any of the remaining memory depths; and controlling the intensity level of that portion of each raster line bounded by the first memory depth and any of the remaining memory depths.

41. The invention of claim 1 wherein the calligraphic symbology generator is provided with a second output for connection to a second input to the raster scanned matrix display for providing to the display stroked calligraphic symbology.

42. The invention of claim 41 wherein the stroked calligraphic symbology is displayed on the matrix display simultaneously with the raster scanned format calligraphic symbology.

43. A raster display generating system having means for converting calligraphic symbology information into raster scanned symbology, comprising, in combination:

a raster scanned matrix display for displaying information to an observer, the matrix display having a first input for receiving raster scanning video signals and a second input for receiving stroked calligraphic symbology;

a calligraphic symbology generator for converting information to be displayed into calligraphic symbology by stroking complete symbols, the generator having an output delivering stroked calligraphic symbology;

a calligraphic display having an input for receiving stroked calligraphic symbology from the generator; and a raster image buffer having an input for receiving from the generator output stroked calligraphic symbology and for converting the symbology into raster scanned format and for storing for later display on the matrix display, the buffer having an output providing raster scanned video signals to the first input of the matrix display;

whereby calligraphic symbology may be stroked into the calligraphic display and the matrix display and may be converted into raster scanned video signals for display on the matrix display, simultaneously or otherwise.

* * * * *